US010563836B2

(12) United States Patent
Fischer et al.

(10) Patent No.: US 10,563,836 B2
(45) Date of Patent: Feb. 18, 2020

(54) LIGHTING APPARATUS FOR VEHICLES

(71) Applicant: HELLA GmbH & Co. KGaA, Lippstadt (DE)

(72) Inventors: Bernd Fischer, Altenbeken (DE); Paul Friesen, Rheda-Wiedenbrueck (DE); Joerg Sieme, Georgsmarienhuette (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/366,589

(22) Filed: Mar. 27, 2019

(65) Prior Publication Data

US 2019/0301696 A1 Oct. 3, 2019

(30) Foreign Application Priority Data

Mar. 27, 2018 (DE) ..... 10 2018 107 213

(51) Int. Cl.

| | |
|---|---|
| ***F21S 41/40*** | (2018.01) |
| ***F21S 41/43*** | (2018.01) |
| ***F21V 11/08*** | (2006.01) |
| ***F21V 5/04*** | (2006.01) |
| ***F21S 41/265*** | (2018.01) |
| ***F21S 41/20*** | (2018.01) |

(52) U.S. Cl.
CPC ..... *F21S 41/40* (2018.01); *F21S 41/265* (2018.01); *F21S 41/285* (2018.01); *F21V 5/04* (2013.01); *F21V 11/08* (2013.01)

(58) Field of Classification Search
CPC ..... F21S 41/40; F21S 41/43; F21S 41/285
USPC ..... 362/521
See application file for complete search history.

(56) References Cited

U.S. PATENT DOCUMENTS

| | | | | |
|---|---|---|---|---|
| 7,153,009 | B2 * | 12/2006 | Tatsukawa | B60Q 1/04 362/507 |
| 2004/0160772 | A1 * | 8/2004 | Tatsukawa | B60Q 1/04 362/244 |
| 2004/0257827 | A1 * | 12/2004 | Ishida | F21S 41/147 362/545 |
| 2006/0285312 | A1 * | 12/2006 | Ogawa | G02B 3/005 362/97.2 |

(Continued)

FOREIGN PATENT DOCUMENTS

| | | | |
|---|---|---|---|
| DE | 10205779 | A1 | 10/2003 |
| DE | 102013107355 | A1 | 1/2015 |
| EP | 2327926 | A1 | 6/2011 |

*Primary Examiner* — Christopher M Raabe
(74) *Attorney, Agent, or Firm* — Muncy, Geissler, Olds & Lowe, P.C.

(57) ABSTRACT

A lighting apparatus for vehicles having a light source unit containing a number of light sources, having an optical unit disposed in front of the light source unit in the main emission direction and containing a number of optical elements for imaging the light source according to a predetermined light distribution, having an additional element containing a cutout for the light source, wherein the additional element is designed as an adjustment screen and the cutout as a screen opening, wherein the adjustment screen extends in a screen plane extending perpendicular to an optical axis of the optical unit between a light input face of the optical unit and a light source plane accommodating the light source, the light source has a contour, extending in the light source plane with light source edges which delimit a light-emitting face of the light source.

10 Claims, 2 Drawing Sheets

(56) References Cited

U.S. PATENT DOCUMENTS

| | | | | |
|---|---|---|---|---|
| 2009/0180276 | A1* | 7/2009 | Benitez | G02B 6/0036 362/97.4 |
| 2011/0222303 | A1* | 9/2011 | Tokida | F21S 41/147 362/516 |
| 2014/0063833 | A1* | 3/2014 | Park | F21S 41/143 362/520 |
| 2014/0146553 | A1* | 5/2014 | Hering | F21S 41/19 362/509 |
| 2014/0153276 | A1* | 6/2014 | Nozaki | F21K 9/60 362/551 |
| 2016/0010811 | A1 | 1/2016 | Benitez et al. | |
| 2016/0018081 | A1* | 1/2016 | Kadoriku | F21S 41/143 362/280 |

* cited by examiner

LIGHTING APPARATUS FOR VEHICLES

This nonprovisional application claims priority under 35 U.S.C. § 119(a) to German Patent Application No. 10 2018 107 213.9, which was filed in Germany on Mar. 27, 2018, and which is herein incorporated by reference.

BACKGROUND OF THE INVENTION

Field of the Invention

The present invention relates to a lighting apparatus for vehicles having a light source unit containing a plurality of light sources, having an optical unit disposed in front of the light source unit in the main emission direction and containing a plurality of optical elements for imaging the light source according to a predetermined light distribution, having an additional element containing a cutout for the light source.

Description of the Background Art

A lighting apparatus for vehicles with a light source unit and an optical unit arranged in front of it in the main emission direction for generating a predetermined light distribution is known from DE 10 2013 107 355 A1. The light source unit comprises, as light sources, LED light sources positioned at a light input side of the optical unit. The LED light sources are located in an object plane for the light distribution to be generated, wherein a contour of the rectangular light source is imaged by means of upstream optical elements of the optical unit. The light sources are each located at a focal point of the upstream optical element. When the lighting apparatus is assembled, the problem arises that the LED light source must be placed exactly at the focal point of the upstream optical element. If the light source is not placed exactly at the focal point of the optical element, the light image of the light source or the light distribution changes greatly. It is therefore important to precisely adjust the light source.

To adjust a light source with respect to an upstream optical unit, it is known from EP 2 327 926 A1 to place an additional element between a circuit board, bearing the light source, and an optical element of the optical unit. This additional element has a fastener so that the light source is placed in a defined relative position to the optical element. For this purpose, the additional element has spring elements, which, on the one hand, engages the circuit board of the light source and, on the other, the support of the optical element. The light source is placed in a cutout of the additional element, namely at the focal point of the upstream optical element. The known additional element enables the compensation of tolerance deviations during the manufacture of the components bearing the optical element and the light source. However, the production-related effort for providing the additional element is relatively great.

SUMMARY OF THE INVENTION

It is therefore the object of the present invention to provide a lighting apparatus for vehicles such that an adjustment of light sources relative to an optical unit can be simplified cost-effectively.

In an exemplary embodiment an additional element is designed as an adjustment screen and the cutout as a screen opening, wherein the adjustment screen extends in a screen plane, extending perpendicular to an optical axis of the optical unit, between a light input face of the optical unit and a light source plane accommodating the light source, in that the light source has a contour, extending in the light source plane, with light source edges which delimit a light-emitting face of the light source, in that the screen opening is disposed at a focal point of the optical unit, wherein the screen opening has a number of screen edges, delimiting the same, and wherein a screen edge, formed as the preferred screen edge, is used to image a cut-off line of the light distribution, and in that the light source is disposed in the light source plane such that a lower long edge of the light source in a vertical projection onto the screen opening intersects a lower screen edge of the screen opening or merges with the same.

An advantage of the invention is that the adjustment effort can be reduced in particular during the manufacture of the lighting apparatus. The cost of the additional element which serves as the adjusting screen and which extends as a screen in a plane between a light source plane and a light input plane of an optical unit is relatively low. The adjustment screen is disposed with its screen opening in a defined position, namely at a focal point of the optical unit, wherein a preferred screen edge of the adjustment screen is imaged by the optical unit to form a cut-off line of the generated light distribution. The basic idea of the invention therefore is that not a light source edge but a preferred screen edge of the adjustment screen is used to image the cut-off line. The light source can thus be tilted or rotated, for example, about an optical axis of the optical unit, without the position of the cut-off line changing. Only a change in the light intensity in the light distribution is taken into account. The position of the cut-off line is not affected by this. Advantageously, a lighting apparatus production, tolerance-insensitive with respect to the relative position of the light source to the optical unit, can take place without a readjustment being required later.

The adjustment screen can be materially connected as a screen layer to the optical element on a side, facing the light source, of an optical element of the optical unit. Advantageously, by applying the screen layer, the preferred screen edge can be placed precisely in terms of manufacturing technology. Here, the preferred screen edge is precisely matched to an optical element of the illumination optics. The cut-off line in the light distribution to be imaged is determined by the screen layer or the fixing of the preferred screen edge. Even if the light source is not optimally aligned with the screen opening created by the screen layer, the cut-off line is always sharply imaged. Advantageously, a tolerance-insensitive determination of the cut-off line can be carried out as a result. The adjustment effort can be reduced. If the light source is not optimally adjusted, this only affects the light distribution in regard to the light intensity distribution, but not the cut-off position.

The screen layer can be produced by vapor deposition or coating. The screen layer is thus made relatively thin, so that in addition there is no increased space requirement.

The contour of the screen opening can be formed adapted to the contour of the light source, wherein the preferred screen edge is always formed as a straight line or as a straight line with a 15° rise in an asymmetric low-beam distribution. The screen opening is always formed larger than a light-emitting face of the light source, so that the largest possible proportion of the light output emitted by the light source can be transmitted.

The optical element of the optical unit can have a collimating lens section and an axial extension section on a side facing the light source, wherein the extension section has a light input face. The light input face is provided with the screen layer. Advantageously, the provision of an axial extension section creates a thermal buffering or a decoupling of the light source with respect to the temperature-sensitive collimating lens section. Preferably, the axial extension section is formed out of a material that is thermally insulating relative to the collimation section.

The collimating lens section of the optical element can be made out of a plastic material and the axial extension section can be made out of a thermally insulating plastic material. For example, the axial extension section can be formed of a silicone material, so that a thermal decoupling is created between the light source and the collimating lens section formed of, for example, a polycarbonate.

The collimating lens section and the axial extension section can be formed of a glass material, which are integrally connected to one another. Advantageously, the production can be simplified thereby.

The optical unit can have a microlens array with a plurality of fixedly formed microlenses. For example, the microlenses can have a cylindrical outer surface for the horizontal deflection of the light. A further outer surface of the microlenses can have prismatic surfaces, so that a vertical deflection of the light is ensured. The light collected by the collimating lens section can thus be widened in the vertical and horizontal directions according to the predetermined light distribution.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A lighting apparatus of the invention for vehicles is preferably designed as a headlight, which is installed in a front-end area of a motor vehicle.

The lighting apparatus has a light source unit 1 with a plurality of light sources 2. Light sources 2 are formed as LED light sources, which are attached as light source chips to a printed circuit board.

Figure 3:
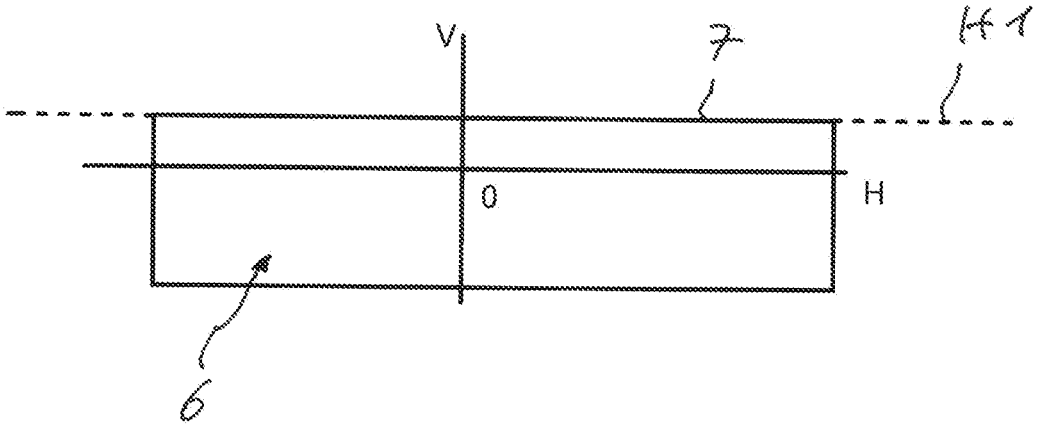
FIG. 3 is a schematic representation of a light distribution with a cut-off line.

An optical unit 3, which can be formed an illumination optics 4 and a projection optics 5, is disposed in the main emission direction H in front of light source unit 1. Illumination optics 4 is used to parallelize the light emitted by light sources 2. Projection optics 5 is designed such that the light coming from illumination optics 4 is deflected in accordance with the predetermined light distribution. In the present exemplary embodiment, projection optics 5 is designed such that a symmetrical low-beam light distribution 6 corresponding to FIG. 3 with a cut-off line 7 is produced.

In the present exemplary embodiment, illumination optics 4 has a number of optical elements 8 which are assigned to light sources 2 and are each assigned to a light source 2. Optical elements 8 each have a collimating lens section 9 for parallelizing the light and an axial extension section 10 disposed behind the same in the main emission direction H. Axial extension section 10 has a light input face 11 for the light emitted by light sources 2. Light input face 11 of optical element 8 is thus arranged on a side, facing light source 2, of optical element 8. In the present exemplary embodiment, light input face 11 is formed flat.

Optical element 8 on its light input side is provided with an adjustment screen 12. Adjustment screen 12 serves as an additional element to optical element 8 and has as a cutout a screen opening 13, which serves as a passage or aperture for the light emitted by the respective light source 2. Adjustment screen 12 extends in a screen plane B, which extends adjacent to light input face 11 of optical element 8. Screen opening 13 of adjustment screen 12 is disposed at a focal point of optical element 8 or collimating lens section 9.

Preferably, adjustment screen 12 is formed as a screen layer, which is materially connected to light input face 11 of optical element 8. For example, screen layer 12 can be applied to light input face 11 of optical element 8 by vapor deposition or coating. If screen layer 12 is applied by vapor deposition, it can have, for example, a thickness in the range of 60 nm to 120 nm. If screen layer 12 is applied to light input face 11, for example, by coating, it can have a layer thickness in the range of 50 μm to 1 mm.

Light source 2 extends in a light source plane L, which runs parallel to screen plane B. Screen plane B extends between light source plane L and light input face 11. Light input face 11 is also made flat. Light source 2 is thus disposed behind screen opening 13 in the main emission direction H, therefore, in the direction of an optical axis A of optical element 8, offset relative to adjustment screen 12 or screen opening 13.

Screen opening 13 of adjustment screen 12 is formed adapted in its contour to the contour of light source 2. In the present exemplary embodiment, light source 2 has a rectangular contour with an upper long edge 14 and a lower long edge 15 and two connecting narrow sides 16. Screen opening 13 has an upper screen edge 17, a lower screen edge 18, and narrow sides 19 connecting the same. As can be seen from FIG. 2, the dimension of screen opening 13 is greater than the dimension of light source 2 or its light-emitting face 22.

Lower screen edge 18 serves as a preferential screen edge, which is imaged by optical unit 3 to form cut-off line 7 of the low-beam light distribution 6. Collimating lens section 9 is formed such that the light passing through screen opening 13 is parallelized. Projection optics 5 causes a corresponding image of this rectangular light spot on an appropriate aiming screen, which is arranged at a predetermined distance from the vehicle.

Even if the lower long edge 15 of light source 2 is not horizontal but slightly tilted to the side or pivoted about optical axis A of optical element 8, wherein the lower long edge 15 encloses an acute angle φ to a horizontal plane 20, there is a sharp imaging of cut-off line 7 in a horizontal line H1 of light distribution 6, because not the contour of light source 2 but the contour of screen opening 13 is imaged by optical unit 3, wherein the preferred screen edge 18 is imaged to form cut-off line 7.

Thus, a sharp cut-off line 7 with a predetermined course advantageously arises, even if light source 2 is arranged not optimally adjusted relative to collimating lens section 9. Only light intensity losses result, because a portion 21 of the light-emitting face 22 of light source 2 is covered by adjustment screen 12 and thus cannot enter optical unit 3 or optical element 9, as is drawn cross-hatched in FIG. 2.

Figure 1:
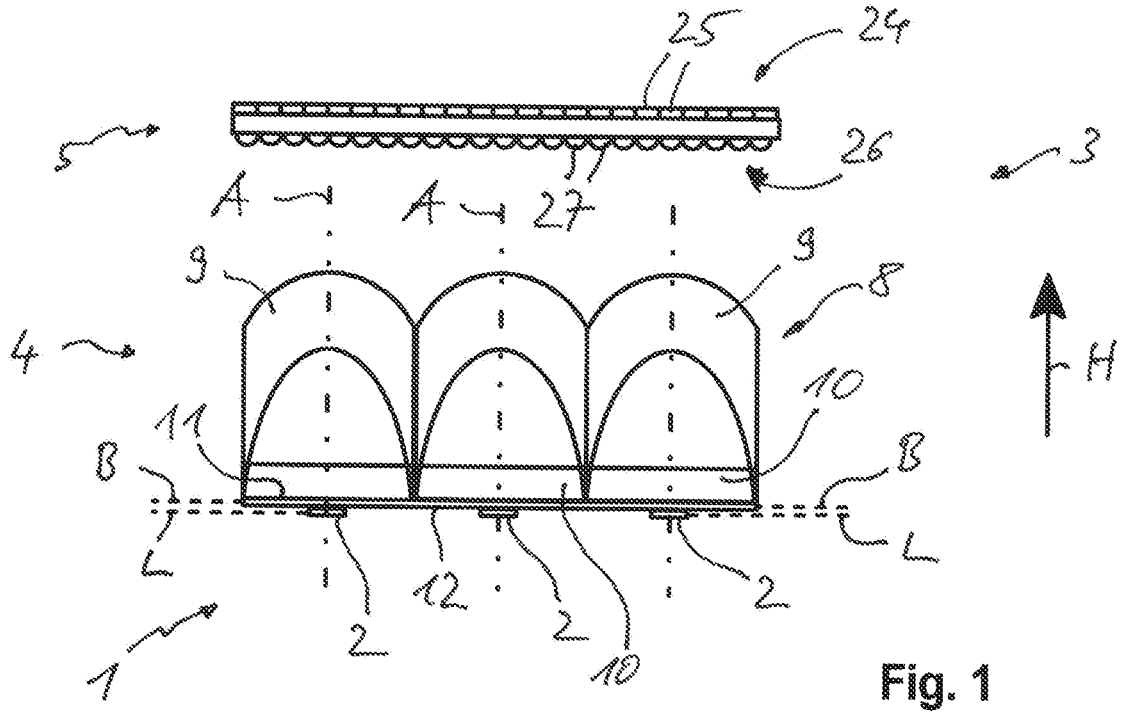
FIG. 1 is a schematic top plan view of a lighting apparatus.
Figure 2:
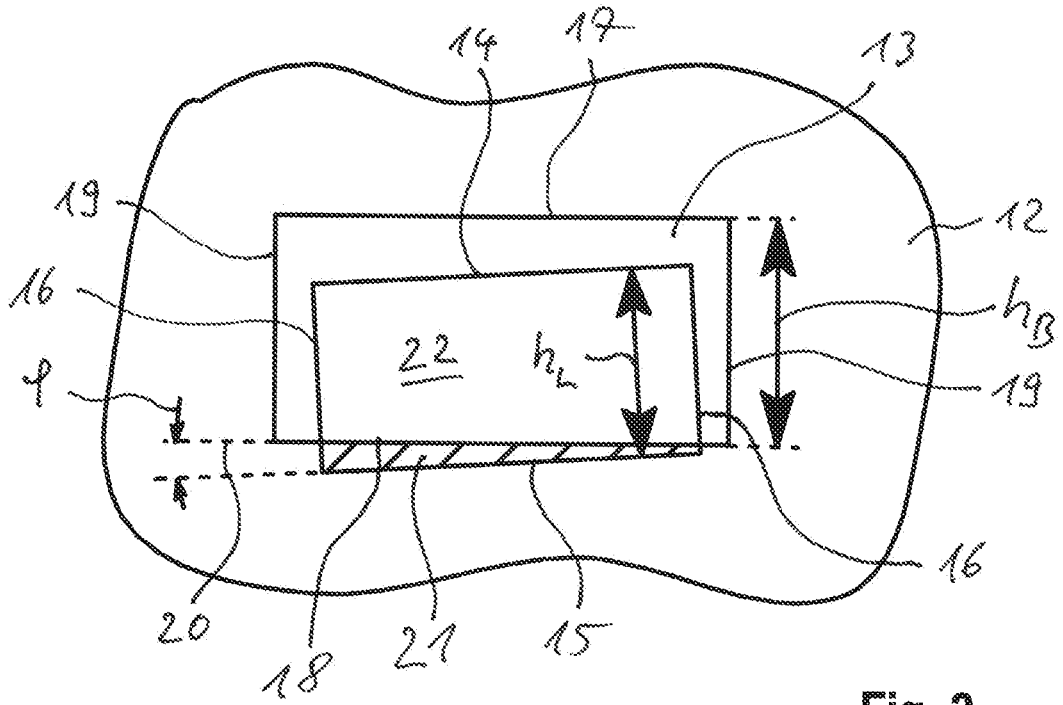
FIG. 2 shows a section of a rear view of an optical element provided with an adjustment screen with a screen opening.

When light source 2 is mounted, it is to be ensured that the lower long edge 15 of light source 2 intersects or merges with the lower screen edge 18 of screen opening 13. If the light-emitting face 22 of light source 2, which is smaller in its dimension than screen opening 13, were to be disposed inside screen opening 13, a tilted arrangement of light source 2, as shown in FIG. 2, would lead to an undesired tilted arrangement of cut-off line 7.

According to an embodiment of the invention, a height $h_B$ of screen opening 13 can also be formed equal to a height $h_L$ of light source 2, so that an alignment of the lower long edge 15 of light source 2 to the preferred screen edge 18 of adjustment screen 12 can be dispensed with. The disadvantage here, however, is that due to a possible tilting of light source 2 the upper long edge 14 of light source 2 intersects the upper screen edge 17 of screen opening 13, so that there is an increased loss of light intensity. This embodiment of the invention is thus preferably provided in the case of relatively high-intensity light sources 2. In the present exemplary embodiment, the upper long edge 14 of light source 2 does not intersect the upper screen edge 17 of adjustment screen 12. Also, the narrow sides 16 of light sources 2 do not intersect the narrow sides 19 of adjustment screen 12. In the ideal case, only the lower long edge 15 of light source 2 intersects the lower screen edge 18 of screen 12 or merges with it.

In the present exemplary embodiment, collimating lens section 9 can be formed of a first plastic material. The axial extension section 10 can be formed of a second plastic material, which acts in a thermally insulating manner relative to collimating lens section 9. The heat radiated from light source 2 thus does not adversely affect collimating lens section 9. In the present exemplary embodiment, collimating lens section 9 is made out of a polycarbonate and axial extension section 10 is made out of a silicone material.

According to an embodiment of the invention, collimating lens section 9 and axial extension section 10 can also be formed of a glass material and be integrally connected to one another.

According to a further embodiment of the invention, optical element 8 can also be only formed of the collimating lens section 9 formed of the glass material, wherein adjustment screen 12 is applied to a light input face of collimating lens section 9.

Projection optics 5 has a first microlens array 24 and a second microlens array 26 with a plurality of fixedly formed microlenses 25, 27. The microlens array 24 arranged downstream in the light path has prisms 25 for the vertical deflection of the light. Microlens array 26 arranged upstream in the light path has cylindrical microlenses 27 for the horizontal deflection of the light. The first microlens array 24 is arranged on a first outer surface of projection optics 5, wherein the first outer surface forms a front side of projection optics 5, therefore, in front in the main emission direction H. The second microlens array 26 is disposed on a second outer surface of projection optics 5, which is disposed at the rear, therefore, behind in the main emission direction H, on a rear side of projection optics 5. The first microlens array 24 is integrally connected to the second microlens array 26.

The first projection optics 5 or the first microlens array 24 and the second microlens array 26 in a projection to optical axis A cover illumination optics 4, which in the present exemplary embodiment is formed by three adjacently arranged optical elements 8.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A lighting apparatus for vehicles comprising:

a light source unit having a plurality of light sources;

an optical unit arranged in front of the light source unit in a main emission direction and containing a number of optical elements for imaging the light source according to a predetermined light distribution; and an additional element containing a cutout for the light source, the additional element being an adjustment screen and the cutout formed as a screen opening, wherein the adjustment screen extends in a screen plane extending substantially perpendicular to an optical axis of the optical unit between a light input face of the optical unit and a light source plane accommodating the light source, wherein the light source has a contour, extending in the light source plane, with light source edges which delimit a light-emitting face of the light source, wherein the screen opening is arranged at a focal point of the optical unit, wherein the screen opening has a plurality of screen edges delimiting the same, wherein a screen edge, formed as the preferred screen edge, is used to image a cut-off line of the light distribution, and wherein the light source is arranged in the light source plane such that a lower long edge of the light source in a vertical projection onto the screen opening intersects or merges with a lower screen edge of the screen opening.

2. The lighting apparatus according to claim 1, wherein the adjustment screen is materially connected as a screen layer to a light input face of an optical element, facing the light source, of the optical unit.

3. The lighting apparatus according to claim 1, wherein the screen layer is applied to the light input face of the optical element by vapor deposition or coating, wherein the screen opening is cut out.

4. The lighting apparatus according to claim 1, wherein the screen opening of the adjustment screen is formed adapted to the contour of the light source, wherein a surface of the screen opening is larger than the light-emitting face of the light source.

5. The lighting apparatus according to claim 1, wherein the optical element has a collimating lens section and, on a side facing the light source, an axial extension section having the light input face.

6. The lighting apparatus according to claim 1, wherein the collimating lens section is formed of a plastic material and the axial extension section is formed a thermally insulating plastic material.

7. The lighting apparatus according to claim 1, wherein the collimating lens section and the axial extension section is formed of a glass material which are integrally connected to one another.

8. The lighting apparatus according to claim 1, wherein the optical unit has a projection module disposed in the main emission direction in front of the collimating lens section with a microlens array containing a plurality of fixedly formed microlenses.

9. The lighting apparatus according to claim 8, wherein the projection optics has the microlens array with prism-shaped microlenses for the vertical deflection of the light on a first outer surface and the second microlens array with cylindrical microlenses for the horizontal deflection of the light on a second outer surface.

10. The lighting apparatus according to claim 1, wherein the light source unit has a plurality of light sources, each of which is associated with an optical element provided with a collimating lens section.

* * * * *